US006568902B2

(12) United States Patent
Aschenbruck et al.

(10) Patent No.: US 6,568,902 B2
(45) Date of Patent: May 27, 2003

(54) DEVICE FOR COOLING A COMPONENT SUBJECT TO TEMPERATURE STRESS OF NONUNIFORM INTENSITY

(75) Inventors: Emil Aschenbruck, Duisburg (DE); Hildegard Ebbing, Oberhausen (DE); Klaus Dieter Mohr, Wuppertal (DE)

(73) Assignee: MAN Turbomaschinen AG GHH BORSIG (DE)

( * ) Notice: Subject to any disclaimer, the term of this patent is extended or adjusted under 35 U.S.C. 154(b) by 16 days.

(21) Appl. No.: 09/898,174

(22) Filed: Jul. 3, 2001

(65) Prior Publication Data

US 2002/0004003 A1 Jan. 10, 2002

(30) Foreign Application Priority Data

Jul. 4, 2000 (DE) ..... 100 32 454

(51) Int. Cl.[7] ..... F01D 25/12
(52) U.S. Cl. ..... 415/116; 415/178
(58) Field of Search ..... 415/116, 176, 415/177, 178, 183, 185, 208.2

(56) References Cited

U.S. PATENT DOCUMENTS

| | | | | |
|---|---|---|---|---|
| 4,329,114 A | | 5/1982 | Johnston et al. | |
| 4,841,726 A | | 6/1989 | Burkhardt | |
| 5,123,241 A | * | 6/1992 | Lotan | 415/178 X |
| 6,226,978 B1 | | 5/2001 | Chandra et al. | |

FOREIGN PATENT DOCUMENTS

| | | |
|---|---|---|
| DE | 30 28 137 A1 | 2/1981 |
| DE | 35 40 943 A1 | 5/1987 |
| DE | 43 28 401 A1 | 3/1995 |
| DE | 198 15 473 A1 | 10/1999 |

* cited by examiner

*Primary Examiner*—Edward K. Look
*Assistant Examiner*—Richard A. Edgar
(74) *Attorney, Agent, or Firm*—McGlew and Tuttle, P.C

(57) ABSTRACT

A symmetrical component of a turbine unit, whose wall is exposed to a hot medium on one side and is subject to nonuniform thermal stress over the circumference, is cooled by a flow of cooling air being guided along the other side of the component. A ring (5) is provided with slots (7) or other openings for the passage of the cooling air. The ring (5) protrudes into the flow of the cooling air. The overall cross section of the slots (7) that are arranged in the sections of the ring (5) that are adjacent to the areas of the component that are subject to the higher stress is larger than the overall cross section of the slots (7) that are arranged in the sections of the ring (5) that are adjacent to the areas of the component that are subject to a lower stress.

9 Claims, 5 Drawing Sheets

DEVICE FOR COOLING A COMPONENT SUBJECT TO TEMPERATURE STRESS OF NONUNIFORM INTENSITY

FIELD OF THE INVENTION

The present invention pertains to a device for cooling a symmetrical component of a turbine unit subject to high temperatures of nonuniform intensity over its circumference wherein the wall of the component is exposed to a hot medium on one side and is cooled on the other side by a flow of cooling air guided along that side.

BACKGROUND OF THE INVENTION

Such components are provided in various areas in gas and steam turbine units. A special application is the two-armed gas collection pipe, also called bifurcated pipe, which is provided with two inlet pipe branches and is arranged in gas turbine units between the combustion chamber housings and the inlet pipe branch of the turbine blades (DE-OS 198 15 473). Due to the special shape of the inlet pipe branches of this gas collector pipe, the middle areas in its outlet cross section are subject to substantially higher thermal stress than the upper and lower areas.

The outlet cross section is cooled by cooling air being guided along the side facing away from the hot gas. This cooling air is taken from the compressor of the gas turbine unit. In a gas turbine unit known from practice, the amount of cooling air is limited by slots, which are arranged in the ring-shaped inner flange of the gas collector pipe, which flange joins the companion flange of the turbine. These slots are arranged distributed uniformly over the circumference of the inner flange in the prior-art gas turbine unit. Due to the asymmetric exposure to temperature due to the hot gas flows arriving from the two combustion chambers in combination with the symmetrical distribution of the cooling air, the material temperature will be nonuniform in the circumferential direction at the inner flange of the gas collector pipe. However, the service life of such components subject to high temperatures is determined by the maximum material temperatures occurring, so that the zones with markedly lower temperatures do not have a favorable effect on the service life. This means that the service life potential is lost because of the nonuniform temperature distribution. Moreover, the nonuniform temperature distribution on the circumference may lead to warping and bulging.

SUMMARY AND OBJECTS OF THE INVENTION

The basic object of the present invention is to make uniform the cooling of components of this type which are subject to nonuniform thermal stress without extra cost.

According to the invention, a device is provided for cooling a symmetrical component of a turbine unit, which component is subject to nonuniform stress over the circumference due to high temperatures. The wall of the component is exposed to a hot medium on one side and is cooled on the other side by a flow of cooling air guided along that side. A ring protrudes into the flow of the cooling air and is provided with slots or other openings for the passage of the cooling air. The ring is connected to the component. The overall cross section of the slots arranged in sections of the ring that are adjacent to the areas of the component that are subject to the higher stress is larger than the overall cross section of the slots that are arranged in the sections of the ring that are adjacent to the areas of the component that are subject to a lower stress.

The slots in the ring may be arranged distributed nonuniformly over the circumference of the ring. A distance between the slots may be smaller in the sections of the ring that are adjacent to the areas of the component that are subject to the higher stress. The slots may have different widths over the circumference of the ring. In such case, the width of the slots is greater in the sections of the ring that are adjacent to the areas of the component with the higher stress.

The intensity of the convective cooling by the cooling air in the outlet cross section is determined by the velocity and the amount of the cooling air that flows along there. To ensure the flow of cooling air in the first place, a pressure difference $\Delta p$ is necessary over the slotted, ring-shaped inner flange. The cooling air flows through the slots arranged on the circumference of the inner flange. The geometry of the slots themselves as well as their arrangement thus directly affect the amount and the distribution of the cooling air due to the distribution on the circumference. The ring-shaped inner flange of the component thus represents the throttling member for the amount of cooling air. A directed, nonuniform, but adapted flow distribution can thus be achieved in the outlet area of the component solely by the arrangement and the geometry (size) of the cooling air slots. This adapted flow distribution is possible without the use of baffle plates or chambers. This is a simple restricted flow guidance by correspondingly setting the geometry of the throttling member for the outlet of the cooling air.

It should be emphasized in particular that the overall area of the cooling air slots is not changed, i.e., the amount of cooling air is not increased, either. The cooling air, which normally cools areas that have only a low temperature stress, is led by this measure to the areas which are subject to a higher temperature stress. As a result, the material temperature of the outlet cross section increases in the cold zones. However, the temperatures drop in the two hot zones, so that a nearly uniform temperature profile is obtained over the circumference.

The advantages arising from the measures according to the present invention comprise a reduction in the local, service life-limiting material temperature, the temperature distribution becoming more uniform, a reduction of temperature stresses, an improvement in the temperature and corrosion resistance, and an increase in the service life of the component.

Another advantage is that an increased cooling air demand is not necessary. Additional cooling air is usually supplied for the hot zones in the methods known and used hitherto to eliminate temperature peaks in components subject to high temperature stresses. However, this additional cooling air is usually not available, or it leads to a reduction in the efficiency of the turbine.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
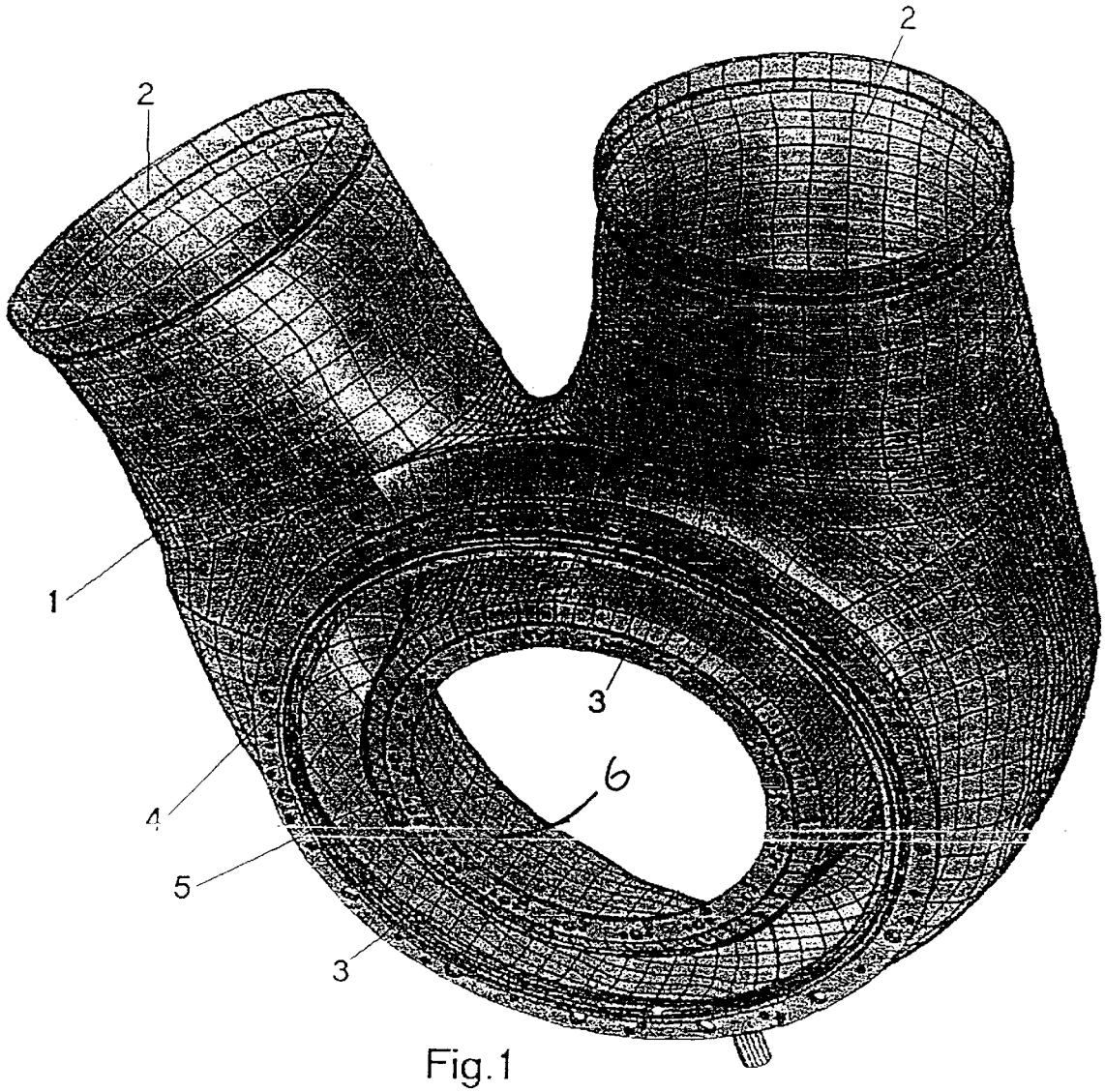
FIG. 1 is a three-dimensional view of a component subject to nonuniform thermal stress.

Referring to the drawings in particular, the component shown as an example in the drawing is a two-armed gas collector pipe 1 carrying hot gas. This component 1 is arranged within a gas turbine unit between the combustion chamber housings, not shown, and the inlet pipe branch of the turbine blades, not shown. The gas collector pipe 1 is provided with two inlet pipe branches 2 for the hot gas from the combustion chambers. The inlet pipe branches open into a gas collector space 3 in the lower part of the gas collector pipe 1. The gas collector pipe 1 is provided with an outer ring flange 4 and with an inner ring flange 5, which are joined to the companion flanges of the gas turbine. The compressed hot gas flows from the combustion chambers through the inlet pipe branches 2 of the gas collector pipe 1 and is brought together and collected in the gas collector space 3 before it flows into the gas turbine and sets the rotor disk with the rotor blades into rotation.

Figure 2:
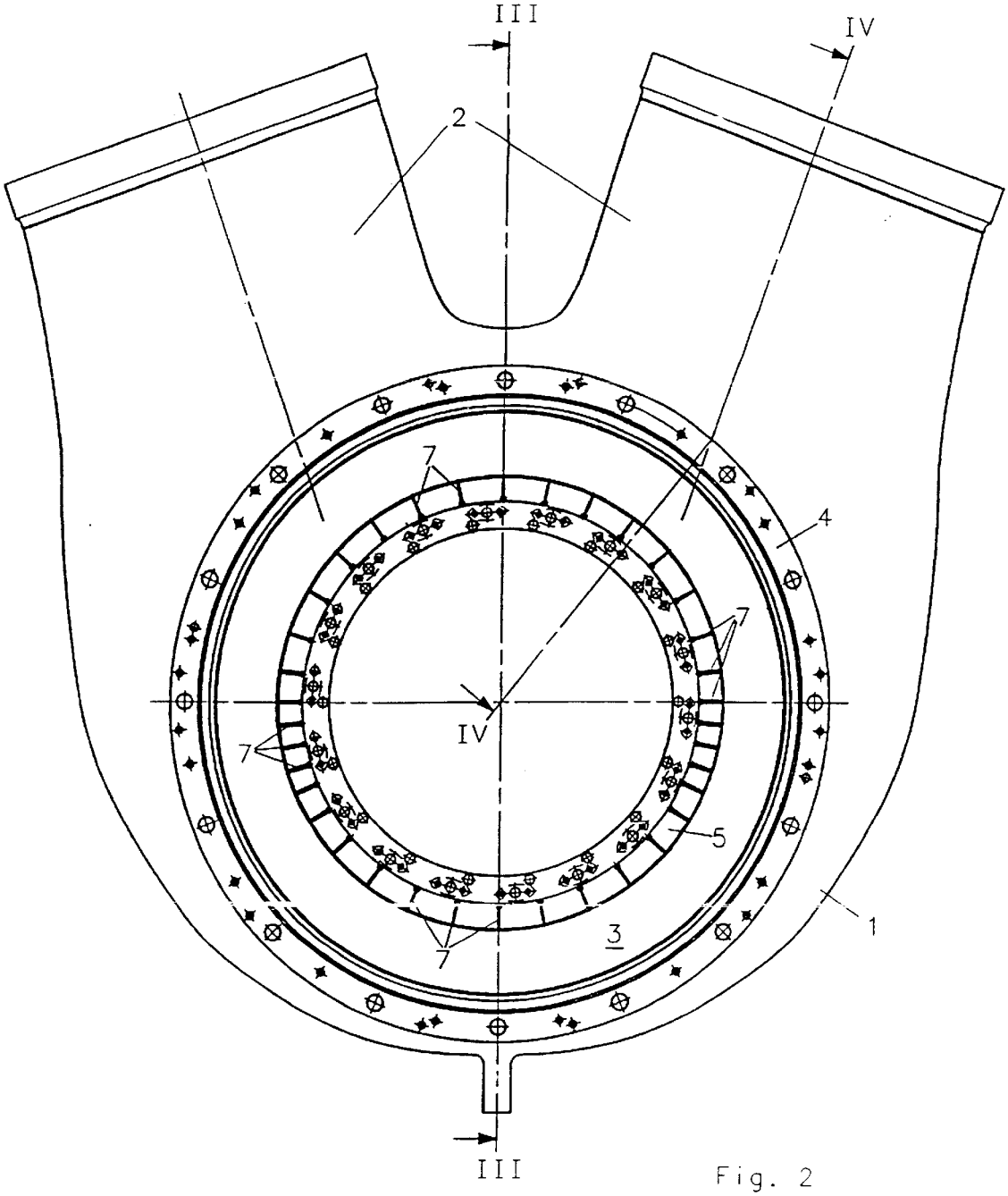
FIG. 2 is a front view of FIG. 1.
Figure 3:
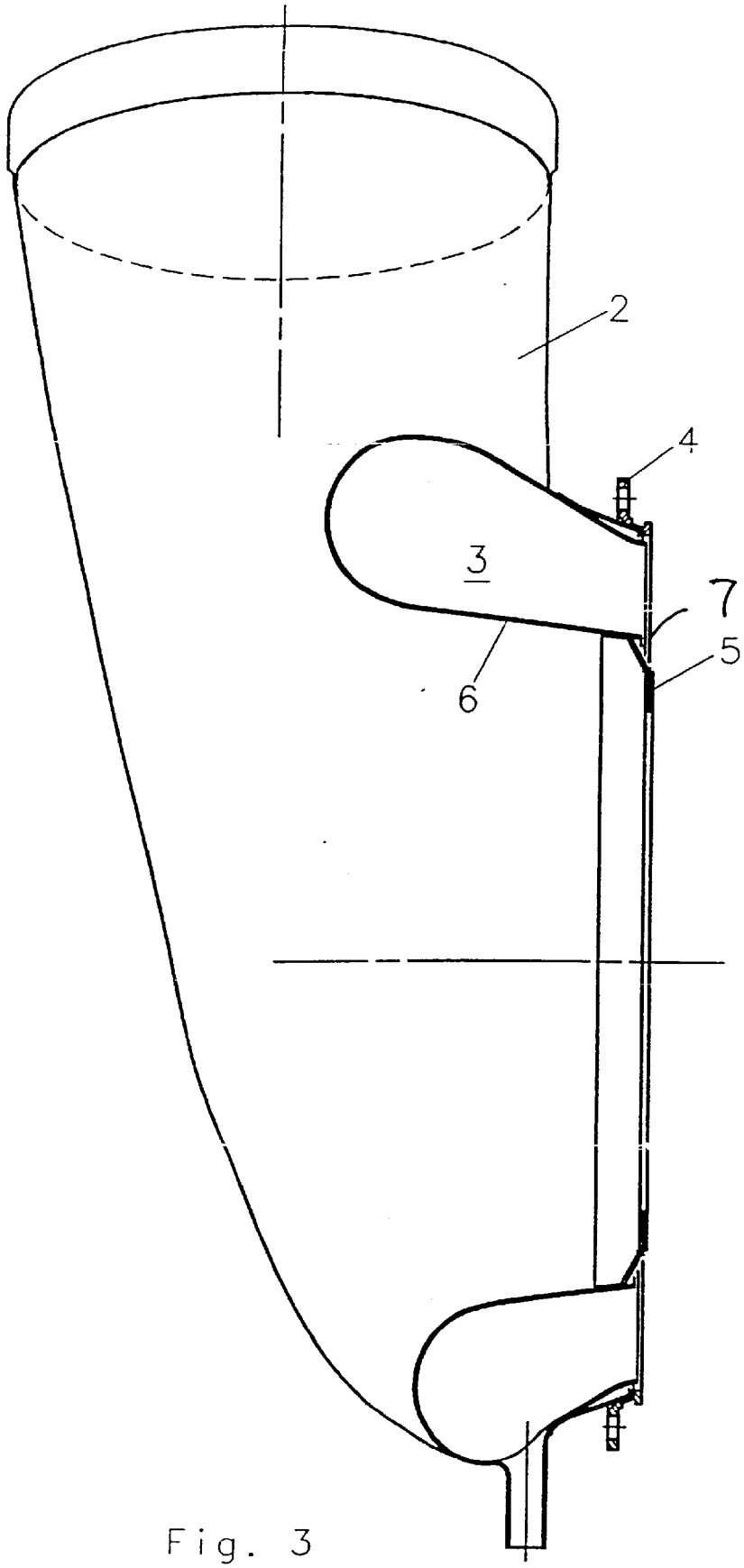
FIG. 3 is a sectional view along line III—III according to FIG. 2.
Figure 4:
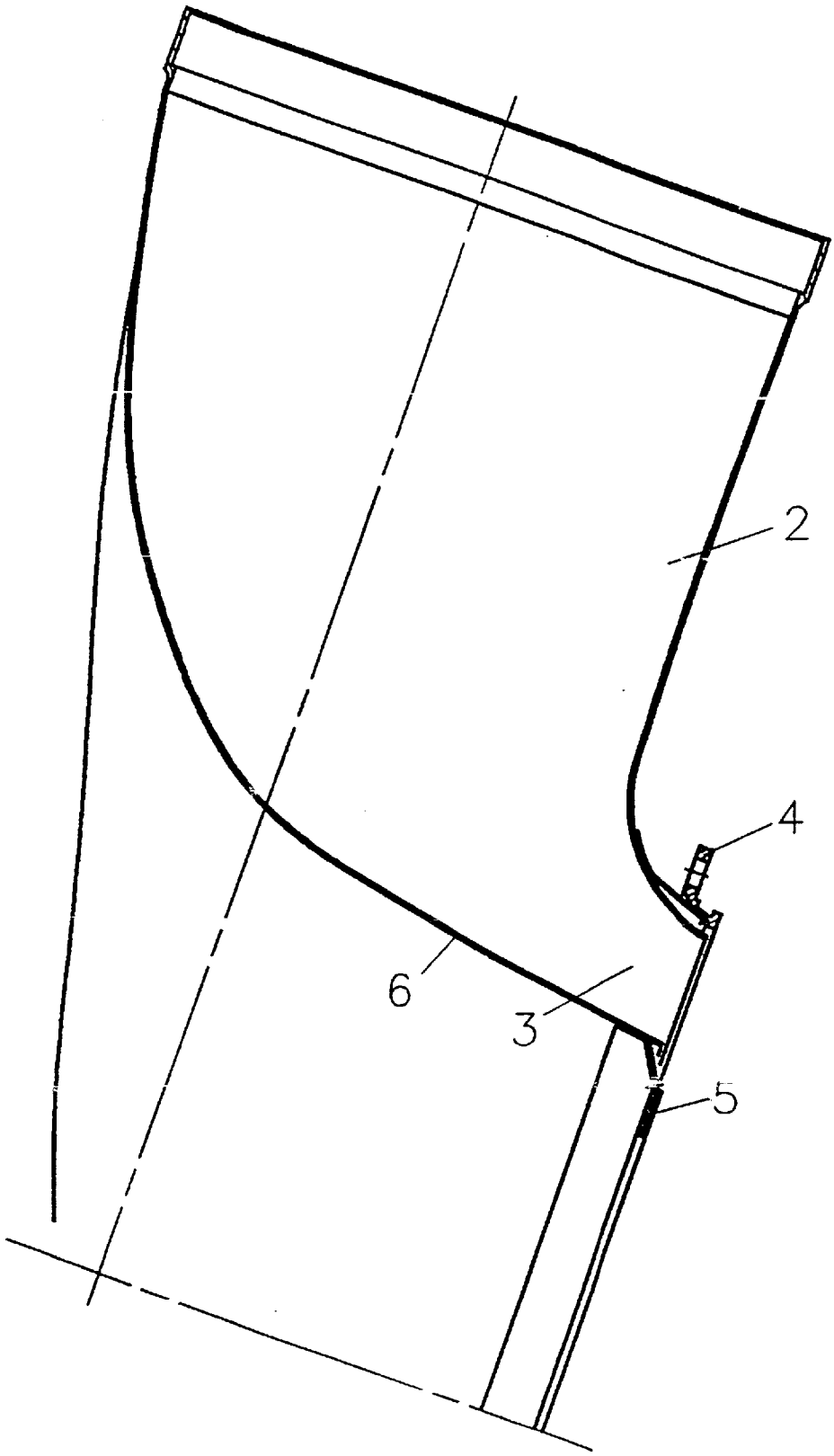
FIG. 4 is a sectional view along line IV—IV according to FIG. 2.
Figure 5:
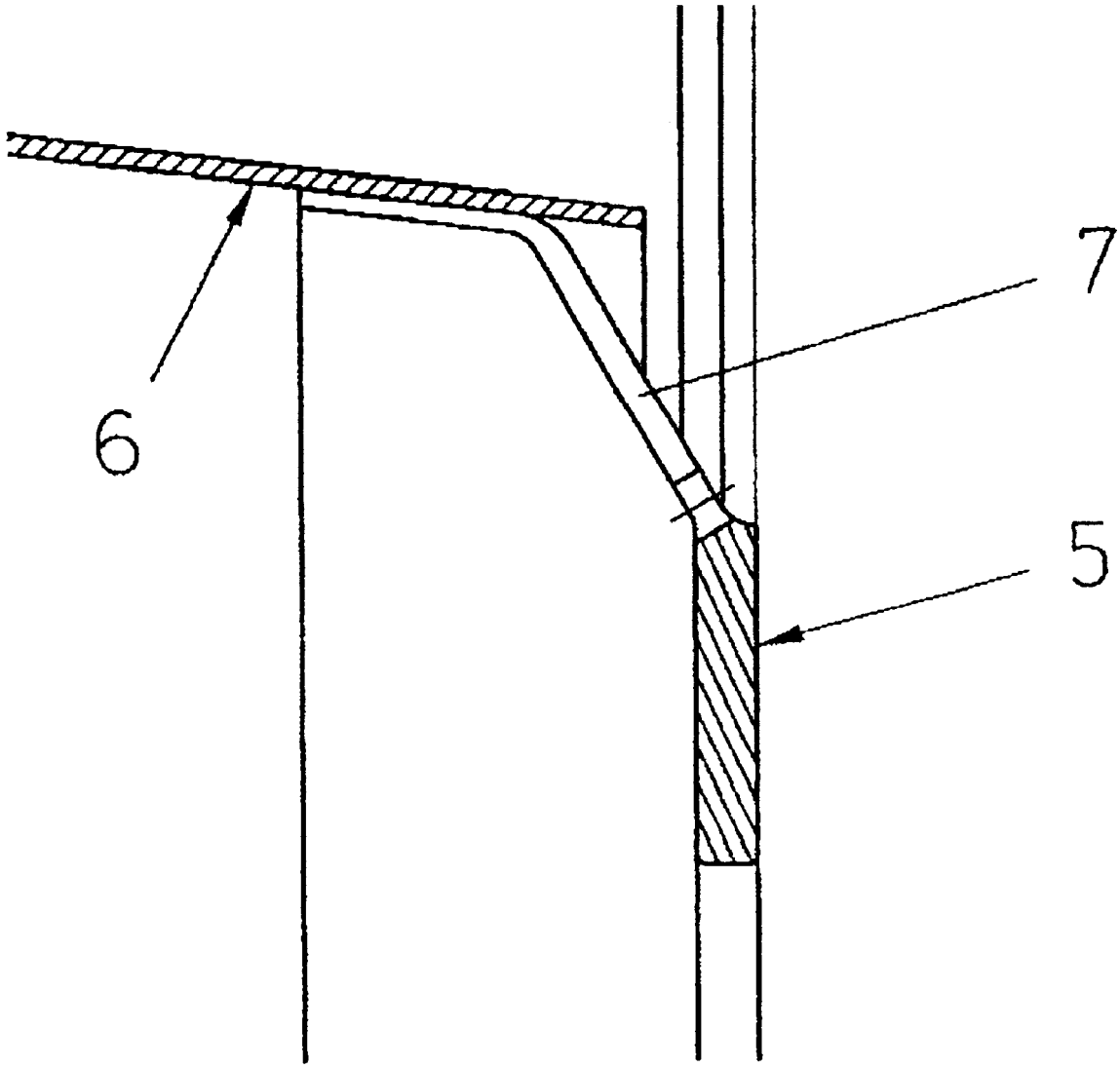
FIG. 5 is an enlarged sectional view of the cooling slot area shown in FIG. 3.

With the design of the inlet pipe branch 2, the gas collector space 3 of the two-armed gas collector pipe 1 is subjected to nonuniform thermal stress. This is due to the hot gas being fed in. The middle areas, which correspond to the 3-o'clock and 9-o'clock positions (viewing FIG. 2), are subject to a higher stress than the upper and lower areas of the gas collector space 3, corresponding to the 6-o'clock and 12-o'clock positions (viewing FIG. 2).

The entire gas collector pipe 1 is cooled convectively on the outside by compressor air which is taken from the compressor of the gas turbine unit. This cooling air is guided, among other things, along the inner cone 6 of the gas collector space 3. Slots 7 or other openings are provided for this purpose in the inner ring flange 5, which protrudes as a ring into the flow path of the cooling air. The cooling air flows off through these slots 7. The driving force for the flow of the cooling air is a pressure difference that builds up on both sides of the slotted inner ring flange 5.

The slots 7 are arranged in the inner ring flange 5 nonuniformly distributed over the circumference of this ring flange. As is apparent from FIG. 2, the distance between the slots 7 is smallest in the sections of the inner ring flange 5 that are adjacent to the areas of the gas collector space 3 with the most intense thermal stress. These are the areas that correspond to the 3-o'clock and 9-o'clock positions. The distance between the slots 7 is greatest in the sections of the inner ring flange 5 that are adjacent to the areas of the gas collector space 3 that are subject to the lowest thermal stress. Due to this distribution of the slots 7, the cooling air flows at a higher intensity along the areas of the gas collector space 3 that are subject to the higher thermal stress.

Due to the nonuniform distribution of the slots 7 of equal width in the inner ring flange 5, it is achieved that the overall cross section of the slots 7, which are arranged in the sections of the inner ring flange 5 that are adjacent to the areas of the gas collector pipe 1 that are subject to greater stress, is larger than the overall cross section of the slots 7 that are arranged in the sections of the ring flange 5 that are adjacent to the areas of the gas collector pipe 1 that are subject to a lower stress. As an alternative, the width of the slots 7 may also be varied in such a way that the slots 7 have different widths over the circumference of the ring flange 5 and the width of the slots 7 is greater in the sections of the ring flange 5 that are adjacent to the areas of the gas collector pipe 1 that are subject to the greater stress. The slots 7 of different width may be arranged distributed uniformly or, as was explained before for the slots 7 of equal width, nonuniformly over the circumference of the inner ring flange 5.

Besides the two-armed gas collector pipe described, the present invention may also be used in components of a similar design which are subjected to nonuniform thermal stress, especially in gas and steam turbine units.

While specific embodiments of the invention have been shown and described in detail to illustrate the application of the principles of the invention, it will be understood that the invention may be embodied otherwise without departing from such principles.

What is claimed is:

1. A device for cooling a symmetrical component of a turbine unit, the turbine unit component having a component wall exposed to a hot medium on a hot medium side and cooled on a cooling air side by a flow of cooling air guided along the other side, the hot medium flow being nonuniform to subject the component to nonuniform stress over a component circumference due to high temperatures of the medium flow with resulting temperature variations of the component wall to form component areas subject to higher stress and component areas subject to lower stress, the device comprising:

a ring connected radially inwardly to the component wall, said ring protruding into the flow of the cooling air, said ring including openings for the passage of the cooling air, said openings including a first portion of openings with an opening cross section, said first portion of openings being adjacent to a component area subject to the higher stress, and a second portion of openings with an opening cross section, said second portion being adjacent to a component area subject to the lower stress, said opening cross section of said first portion being larger than said opening cross section of said second portion to affect the cooling flow along the cooling air side of the component.

2. A device in accordance with claim 1, wherein said openings are slots arranged distributed nonuniformly over the circumference of said ring wherein a distance between adjacent said slots is smaller in said first portion than said second portion.

3. A device in accordance with claim 1, wherein said openings are slots with different widths over the circumference of the ring and a width of slots in said first portion is greater than a width of slots in said second portion.

4. A turbine unit component and cooling device combination, comprising:

a turbine unit component including a component wall exposed to a hot medium flow on one side and exposed to a cooling medium flow on the other side, said component having a structure causing said hot medium flow to be nonuniform causing said component wall to be subject to nonuniform stress over a component circumference due to higher temperatures at areas of said component wall including component areas subject to higher stress and component areas subject to lower stress; and a ring connected radially inwardly to the component wall, said ring protruding into the cooling medium flow, said ring including openings for the passage of the cooling air, said openings including a first section of openings with an opening cross section, said first section of openings being adjacent to one of said component areas subject to higher stress, and a second section of openings with an opening cross section, said second section being adjacent to one of said component areas subject to lower stress, said opening cross section of said first section being larger than said opening cross section of said second section to affect the cooling medium flow on the other side of the component wall.

5. A combination in accordance with claim 4, wherein said openings are slots arranged distributed nonuniformly over a circumference of said ring wherein a distance between adjacent said slots is smaller in said first section than said second section.

6. A device in accordance with claim 5, wherein said openings are slots with different widths over a circumference of said ring and a width of slots in said first section is greater than a width of slots in said second section.

7. A turbine unit component and cooling device combination, comprising:

a turbine unit component having hot medium flow inlet branches leading to an annular space connected to an annular discharge, said annular space and said annular discharge surrounding a cooling medium flow space, said annular space and said annular discharge having a component wall exposed to a hot medium flow from said inlet branches on one side and being exposed to a cooling medium flow on the other side, said component wall being exposed nonuniformly to said hot medium flow based on a position of said hot medium flow inlet branches relative to said annular discharge to subject said component wall to nonuniform temperatures and nonuniform stress over a component wall circumference due to higher temperatures at areas of said component wall including component areas subject to higher stress and component areas subject to lower stress; and a ring connected to the component, said ring protruding into the cooling medium flow space, said ring including openings for the passage of the cooling air, said openings including a first section of openings with an opening cross section, said first section of openings being adjacent to one of said component areas subject to higher stress, and a second section of openings with an opening cross section, said second section being adjacent to one of said component areas subject to lower stress, said opening cross section of said first section being larger than said opening cross section of said second section to affect the cooling medium flow on the other side of the component wall.

8. A combination in accordance with claim 7, wherein said openings are slots arranged distributed nonuniformly over a circumference of said ring w in a distance between adjacent said slots is smaller in said first section than said second section.

9. A device in accordance with claim 7, wherein said opening are slots with different widths over a circumference of said ring and a width of slots in said first section is greater than a width of slots in said second section.

* * * * *